US009932146B1

(12) United States Patent
Katz

(10) Patent No.: US 9,932,146 B1
(45) Date of Patent: Apr. 3, 2018

(54) BUCKET STACK HOLDING APPARATUS WITH EASY RELEASE FEATURE

(71) Applicant: Dennis Katz, North Bend, WA (US)

(72) Inventor: Dennis Katz, North Bend, WA (US)

( * ) Notice: Subject to any disclaimer, the term of this patent is extended or adjusted under 35 U.S.C. 154(b) by 0 days.

(21) Appl. No.: 15/250,380

(22) Filed: Aug. 29, 2016

Related U.S. Application Data

(60) Provisional application No. 62/210,506, filed on Aug. 27, 2015.

(51) Int. Cl.

| | |
|---|---|
| ***B65D 25/10*** | (2006.01) |
| ***B65D 21/02*** | (2006.01) |
| ***B65D 1/16*** | (2006.01) |
| ***B65D 25/32*** | (2006.01) |

(52) U.S. Cl.
CPC ..... *B65D 21/0233* (2013.01); *B65D 1/16* (2013.01); *B65D 25/32* (2013.01); *B65D 21/02* (2013.01); *B65D 21/0209* (2013.01); *B65D 21/0212* (2013.01); *B65D 21/0224* (2013.01)

(58) Field of Classification Search
CPC ..... B65D 21/0233; B65D 1/16; B65D 35/32; B65D 21/02; B65D 21/0209; B65D 21/0212; B65D 21/0224; B65D 25/32
USPC ..... 206/499, 501, 503, 505, 515, 516, 518, 206/519, 821; 220/23.8, 634, 635, 669, 220/4.26, 4.27
See application file for complete search history.

(56) References Cited

U.S. PATENT DOCUMENTS

| | | | | |
|---|---|---|---|---|
| 3,317,087 A * | 5/1967 | Landis | B65D 47/265 206/427 |
| 3,885,672 A * | 5/1975 | Westenrieder | B65D 71/502 206/503 |
| D348,836 S * | 7/1994 | McCallum | D7/397 |
| 2015/0360818 A1* | 12/2015 | Condiff | B65D 25/2897 220/608 |

* cited by examiner

*Primary Examiner* — J. Gregory Pickett
*Assistant Examiner* — Elizabeth Volz
(74) *Attorney, Agent, or Firm* — Dean A. Craine, P.S.

(57) ABSTRACT

An apparatus attached or formed on the sidewalls of a standard 5 gallon bucket with diverging sidewalls that enables stacked buckets to be vertically stacked and locked together so the handle on the upper bucket may be used to carry the stack of buckets and allows the individual buckets to be easily separated from the stack. The apparatus comprises a ring body made of elastic material with a center opening configured to fit transversely around the middle or upper region of the bucket. The ring body includes a downward facing circular groove sufficiently configured to receive and engage the upper edge on the bucket. Located inside the groove may be a protruding outer lip that extends inward and engages the upper edge. In another embodiment, a plurality of hooks are integrally formed on the top surface of the ring body that engage a laterally extending reinforcement ring on the bucket.

12 Claims, 9 Drawing Sheets

BUCKET STACK HOLDING APPARATUS WITH EASY RELEASE FEATURE

This utility patent application is based on and claims the filing date benefit of U.S. provisional patent application (Application No. 62/210,506), filed on Aug. 27, 2015.

Notice is given that the following patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

This invention pertains to plastic buckets, and more particularly to plastic buckets that can be vertically stacked and temporarily locked together so they can be transported using the handle on the top bucket, and then easily pulled apart.

2. Description of the Related Art

Companies sell their products in 5 gallon plastic buckets with wire handles. Some hardware and home improvement stores sell buckets with wired handles. Because they are widely used, homeowners and construction workers often have a collection of buckets they use as collection bins or as lightweight carriers for transporting various items, such as hand tools, boxes of nails or screws, tape measures, extension cords, gloves, goggles, baseballs, tennis balls, etc.

The most common 5 gallon plastic buckets are cylindrical with diverging side walls, are approximately the same height, have circular top openings approximately the same diameter, have continuous flat upper edges, and wire handles. Some buckets include one or more reinforcement rings or apron collars that encircle and extend laterally from the side walls. Because buckets are cylindrical with diverging side walls and with circular top openings approximately the same diameter, they can be easily stacked together by inserting the upper bucket into the lower bucket. The wire handle on the upper bucket can then be used to transport the entire stack.

The side wall on a bucket is typically made of plastic. When the upper bucket is pressed into the lower bucket, the side walls on the two buckets are pressed together. By controlling how far the upper bucket is forced into the lower bucket, the locking forces holding the buckets together can be adjusted. The locking force needed to hold the buckets together can vary depending on the style of buckets and weight of the cargo placed into the buckets. If the upper bucket is inadequately pressed into the lower bucket, the two buckets can separate when the stack of buckets is carried using the wire handle on the upper bucket. If the upper bucket is pressed too far into the lower bucket, pulling the two buckets apart can be difficult.

As stated above, some buckets include integrally formed reinforcement rings or apron collars that extend laterally from the bucket's side walls. These structures may limit how far an upper bucket can be inserted into a lower bucket and may prevent stacked buckets from being locked together entirely, or prevent the user from pressing the upper bucket further into the lower bucket to increase the locking forces that hold the buckets together.

What is needed is an apparatus that can be selectively attached to the side walls on a cylindrical 5 gallon bucket or is integrally formed on the side walls of a 5 gallon bucket that enables the bucket to be vertically stacked and temporarily locked to a lower bucket so the wire handle on the upper bucket may carry the stack of buckets.

What is needed is an apparatus that sufficiently holds two buckets in a stacked configuration even when different weights of cargo are stored inside the lower bucket.

What is also needed is an apparatus that allows either the lower bucket or the upper bucket to be easily removed from the stack of buckets.

SUMMARY OF THE INVENTION

Disclosed is an apparatus in one embodiment that selectively attaches to a standard 5 gallon bucket with a top opening, closed bottom, diverging side walls, and a pivoting wire handle. In another embodiment, the apparatus is integrally formed on the side walls of the bucket. In both embodiments, the apparatus enables buckets to be longitudinally aligned, vertically stacked and temporarily locked together so the wire handle on the upper bucket may be used to carry the stack of buckets. The apparatus also allows either the upper bucket or the lower bucket to be easily detached from the stack.

In one embodiment, the apparatus is a separate ring body made of rigid plastic or hard rubber, silicone with a center opening with a diameter designed to fit around a 5 gallon cylindrical bucket with diverging side walls. The center opening has a sufficient diameter that enables it to fit around the bottom end of the bucket and then slides upward over the bucket. The diameter is smaller than the top opening of the bucket that enables it to fit tightly around the middle or upper region of the bucket. Because the bucket has diverging sidewalls, when the ring body is forced upward on the bucket it presses against the outside surface of the bucket. The inward pressing forces increase as the ring body moves upward over the bucket. Eventually, the inward pressing forces equal the resistant compression forces of the side walls and the ring body becomes locked in a fixed position of the bucket.

The ring body has an edge capturing structure formed on its bottom surface. In one embodiment, the edge capturing structure is a circular groove or slot formed on its bottom surface. The ring body is made of sufficiently flexible material and the circular groove or slot is configured to allow the ring body to snap fit around and securely capture the upper edge of the lower bucket. In one embodiment, the circular groove or slot is oriented so that the top surface of the upper edge of the lower bucket is engaged by pressing the upper bucket downward towards the lower bucket. It should be understood, the circular groove or slot may be horizontally oriented so the outer surface of the upper edge of the bucket is engaged by flexing the ring outward. Formed on the inside surface of the ring body is an inward extending lip configured to extend inward and under the upper edge of the lower bucket when the upper edge extends into the groove or slot.

In another embodiment, the edge capturing structure is a plurality of arms each with a concave opening configured to attach to the upper edge. The concave openings are adapted to capture and engage the upper edge formed on side walls on a lower bucket when aligned vertically and extended around under the upper bucket.

When the ring body is used on an upper bucket with a protruding reinforcement ring or apron collar, the top surface of the ring body may be positioned under the reinforcement ring or apron collar. On some buckets, the diameter of the bucket at the reinforcement ring or apron collar might not create an adequate inward pressing force needed to hold the ring body on the bucket. Therefore, a plurality of upward extending hook elements or arms may be attached or integrally formed on the ring body configured to bend outward and extend around the reinforcement ring or apron collar to capture or increase the frictional forces needed to prevent the ring body from sliding downward over the bucket.

Also formed on the ring is at least one optional extension tab that enables the user to pull the ring body laterally to slightly distort the ring body and disengage circular groove from the upper edge of the lower bucket.

DESCRIPTION OF THE PREFERRED EMBODIMENT(S)

Figure 1:
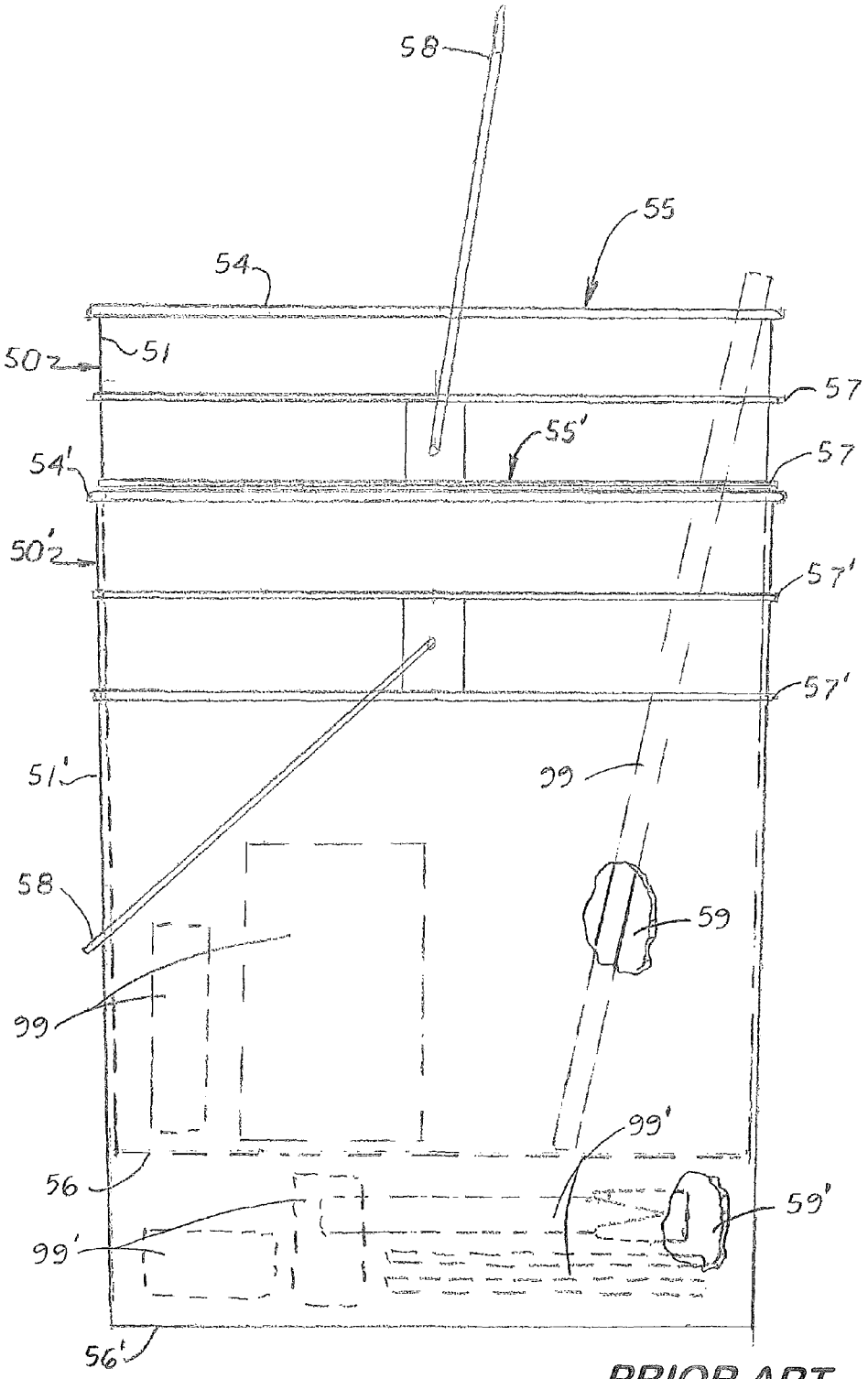
PRIOR ART FIG. 1
FIG. 1 is a side elevational view of two 5 gallon buckets found in the prior art with the upper bucket stacked inside the lower bucket and showing cargo placed inside the storage space inside each bucket.

FIG. 1 is a side elevational view of two 5 gallon buckets 50, 50' each including diverging side walls 51, 51', an upper edge 54, 54' surrounding a top opening, 55, 55', a bottom panel, 56, 56', at least one protruding reinforcement ring 57, 57' formed on the side walls 51, 51, and a wire handle 58, 58', respectively. When aligned in a stacked configuration 60, cargo 99 may be stored in storage space 59 inside the upper bucket 50. Because the upper bucket 50 cannot slide completely into the lower bucket 50', a small storage space 59' for cargo 99' is created in the lower bucket 50'.

Disclosed herein are several embodiments of an apparatus 10 that is selectively attached or integrally formed on the side walls 51 of a bucket 50. The apparatus 10 enables two buckets 50, 50' to be longitudinally aligned, vertically stacked and temporarily locked together so the wire handle 58 on the upper bucket 50 may be used to carry the stack of buckets 60. The apparatus 10 also allows either the upper bucket 50 or the lower bucket 50' to be easily detached from the stack 60 of buckets 50, 50'.

Referring to FIGS. 2-6 there is shown one apparatus 10 configured to selectively attach to the diverging side walls 51 on a cylindrical 5 gallon bucket 50. The apparatus 10 includes a ring body 11 is made of plastic, or hard rubber, silicone or similar elastic material with a center opening 12 with a diameter designed to fit around the diverging side walls 51 on a cylindrical 5 gallon bucket 50. While the apparatus 10 is shown used on a 5 gallon bucket, it should be understood that the size of the ring body 11 may be manufactured in different sizes to fit other size buckets. The center opening 12 is configured so the ring body 11 may slide upward over the outside surface of the bucket 50 and tightly pressed against the bucket's outside surface near the middle or upper region of the bucket 50. The ring body 11 includes an inner surface 14, an outer surface 16, a top surface 18 and a bottom surface 19. In one embodiment, the ring body 11 may be adopted to press firmly against the outside surface 16 of the bucket 50 when forced upward on the bucket 50. The outward resistant forces exerted by the side walls 51 and the inward compression forces exerted by the ring body 11 is sufficient to hold ring body 11 in a fixed position on the bucket 50.

Formed on the bottom surface 19 is an edge capturing structure configured to capture and engage the upper edge of a lower bucket 50' to hold the lower bucket 50' in a stacked position under the upper bucket 50. In one embodiment, the edge capturing structure is a continuous circular groove (also called a slot) 20 formed on the bottom surface 19 on the ring body 11 that is sufficiently wide to snap fit around and engage the upper edge 54' on the lower bucket 50'.

Figure 2:
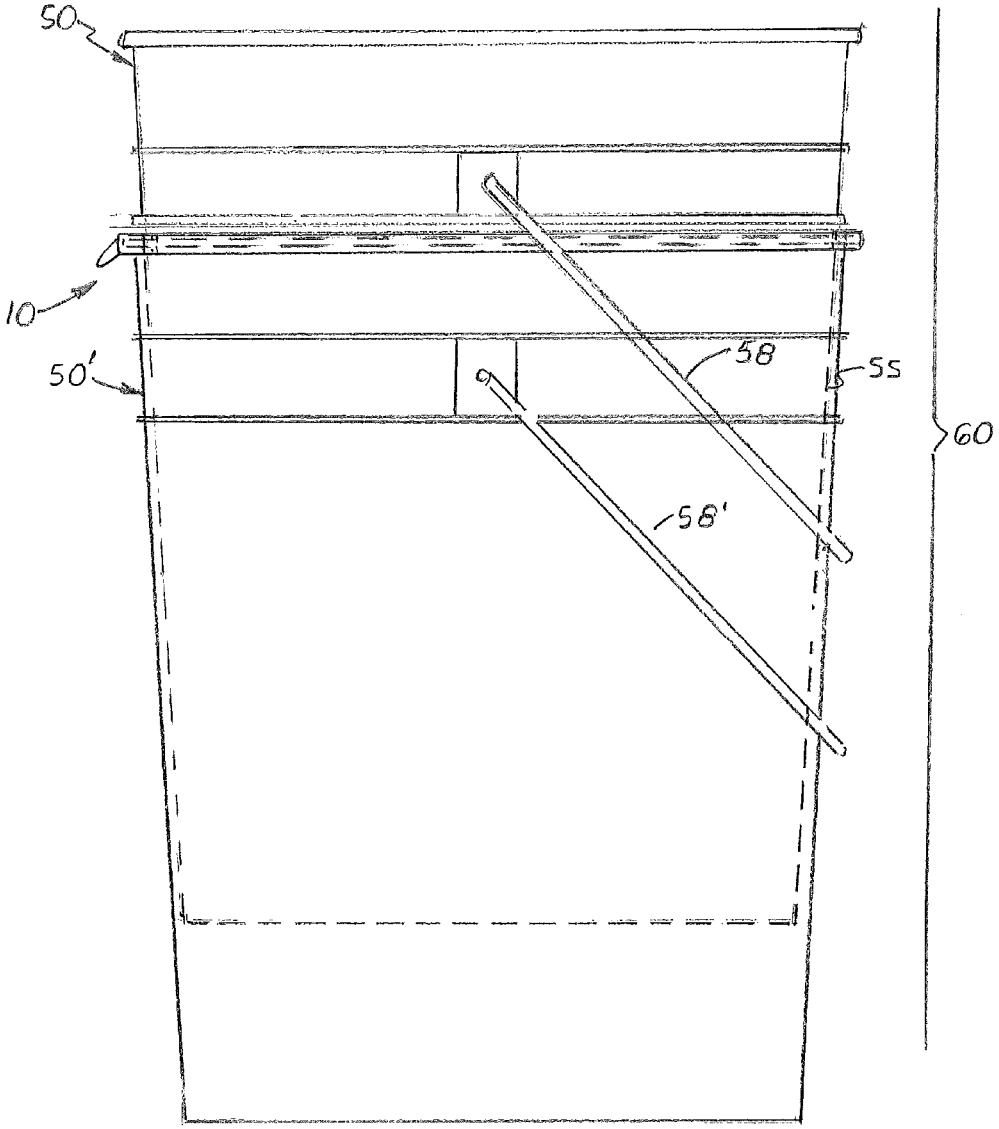
FIG. 2 is a side elevational view of two 5 gallon buckets stacked and held together with a bucket stacking holding apparatus.
Figure 3:
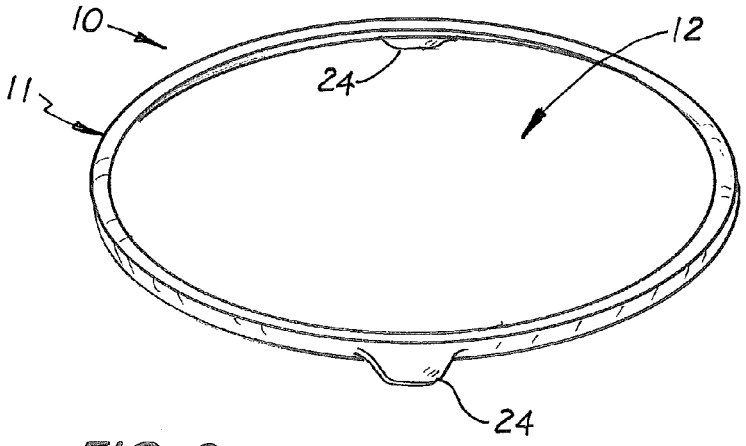
FIG. 3 is a top perspective view of the apparatus that includes a ring body.
Figure 4:
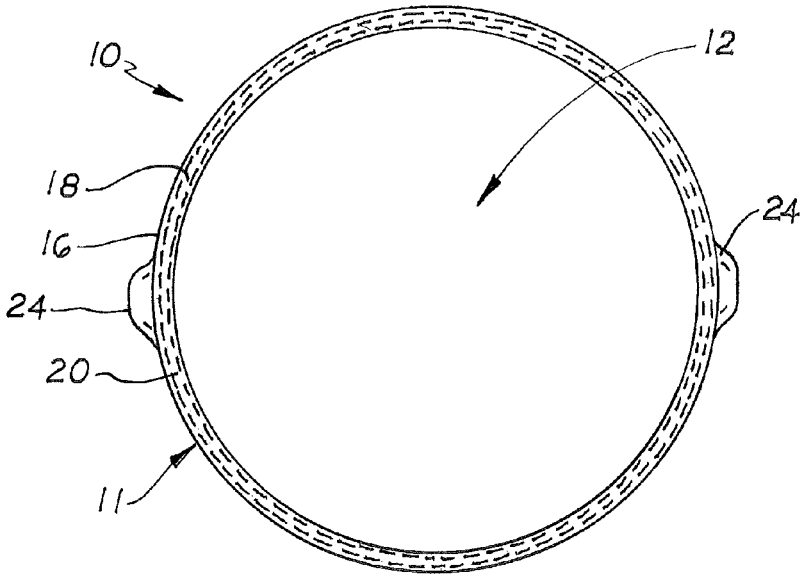
FIG. 4 is a top plan view of the apparatus shown in FIG. 3.
Figure 6:
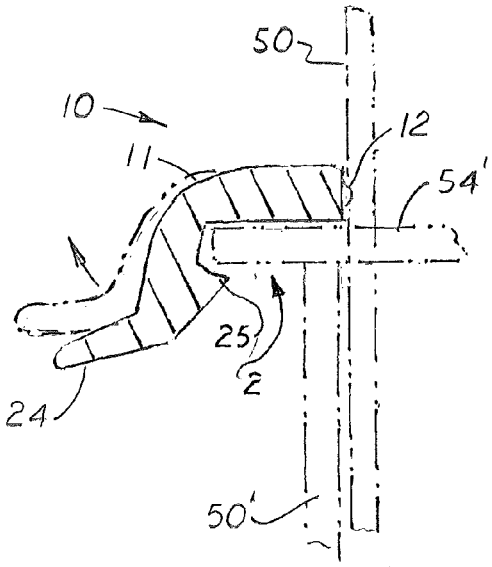
FIG. 6 is a sectional side elevational view taken along line 6-6 in FIG. 5.

The ring body 11 may also be used with buckets 50 with diverging side walls 51 with a protruding reinforcement ring 57 formed on the side walls 51, shown in FIGS. 1, 2 and 6. During use, a 5 gallon bucket 50 is selected and inserted into the center opening 12. The ring body 11 then slides upward until the inner surface 14 of the ring body 11 is forced against the outside surface of the side wall 51. If the bucket 50 includes a reinforcement ring 57, then the ring body 11 may slide upward on the bucket 50 until the top surface 18 of the ring body 11 abuts the bottom surface of the reinforcement ring 57 or the apron collar 130. When used, the reinforcement ring 57 prevents the ring body 11 from sliding upward on the bucket 50.

Figure 7:
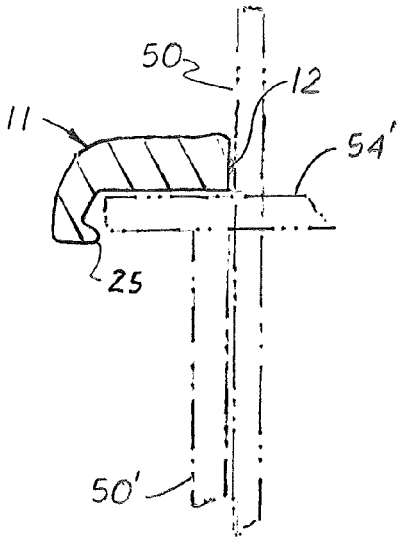
FIG. 7 is a sectional side elevational view taken along line 7-7 in FIG. 5.
Figure 5:
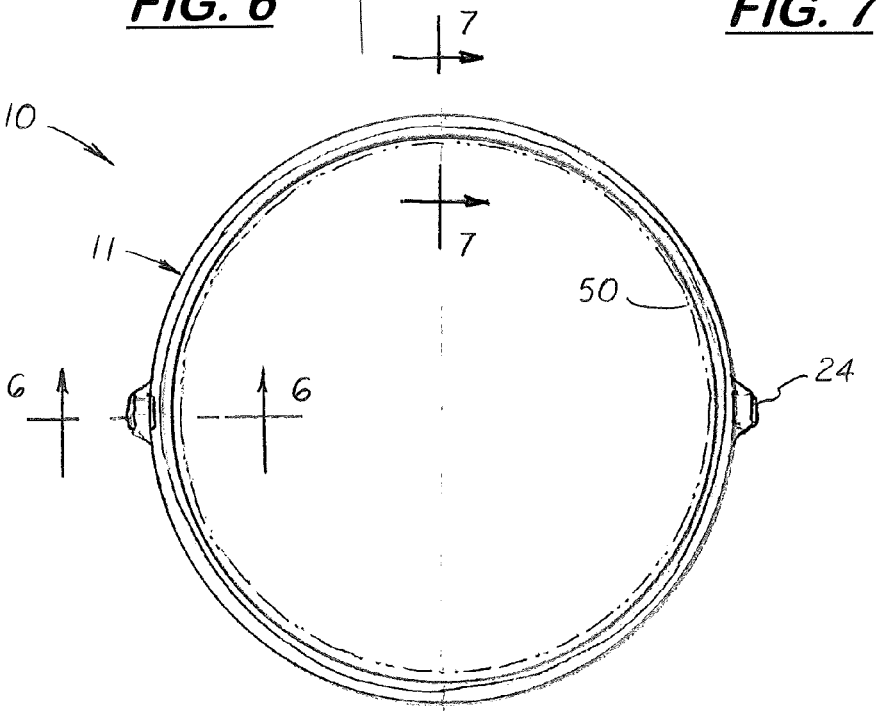
FIG. 5 is a bottom plan view of the apparatus shown in FIGS. 3 and 4 and showing a bucket placed inside the ring body.

As shown in FIGS. 6 and 7, the diameter and width of the circular groove 20 is sufficient to receive the upper edge 54' of the lower bucket 50'. Formed inside the circular groove 20 may be one or more protruding tabs 24 configured to press against and increase the frictional forces exerted against the lower bucket 50'. Formed on the inside surface of the ring body 11 is an inward extending lip 25 configured to extend inward and under the upper edge of the lower bucket 50' when the upper edge extends into the circular groove 24.

As shown in FIGS. 2-6, the ring body 11 may also include at least one laterally protruding tab 24 that allows the user to distort and pry the ring body 11 away from the upper edge 54. In the embodiment in the Figs, the ring body 11 includes two tabs 24 on opposite sides approximately 180 degrees apart.

Figure 8:
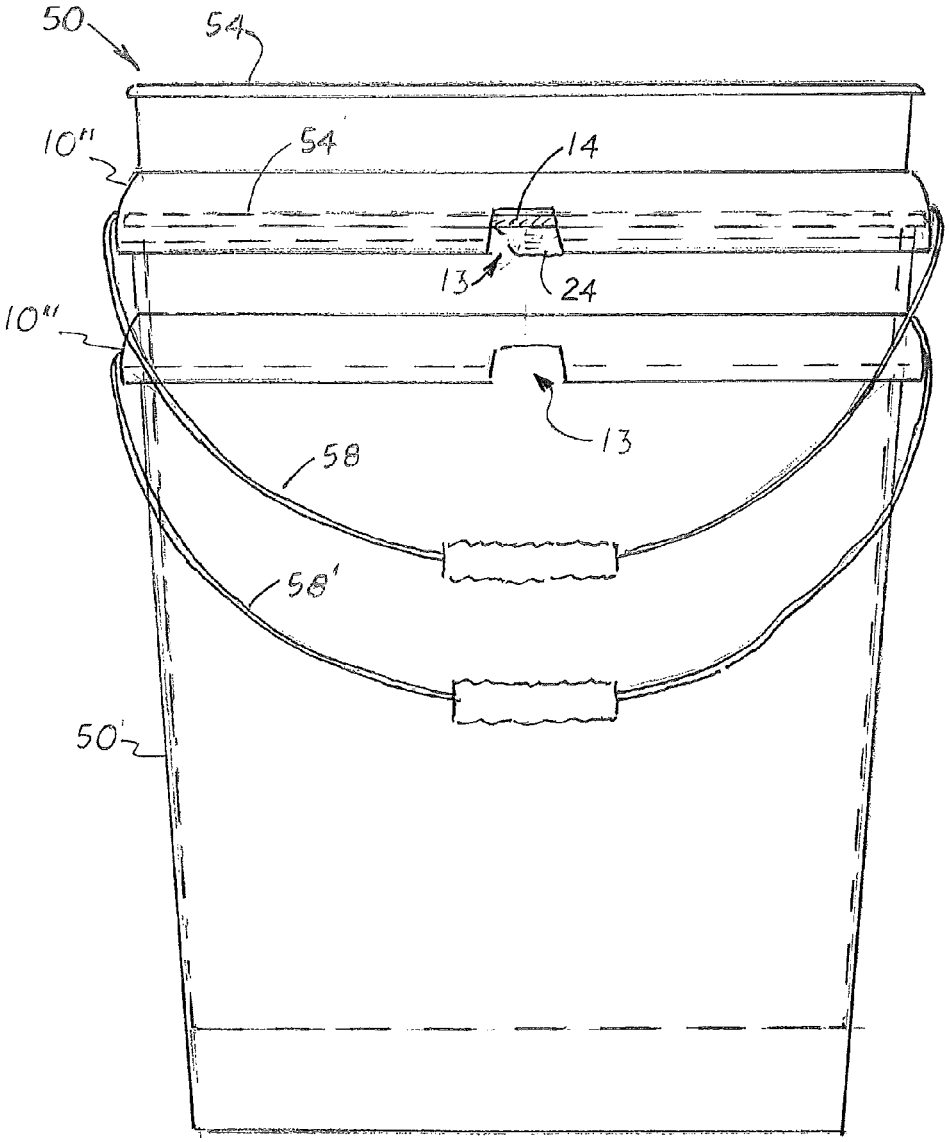
FIG. 8 is a side elevational view of two buckets vertically stacked with the upper edge of the lower bucket inserted into the stacking holding apparatus integrally formed on an apron collar formed on each bucket.
Figure 9:
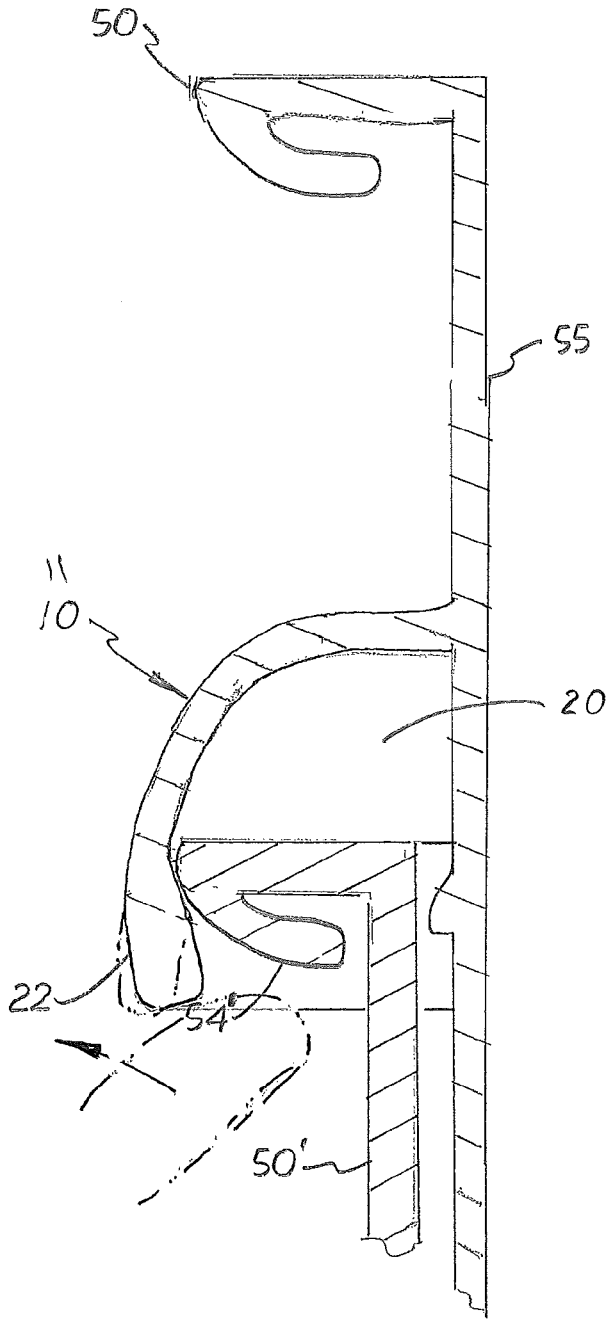
FIG. 9 is a partial, side elevational view of the stacked buckets shown in FIG. 8.
Figure 10:
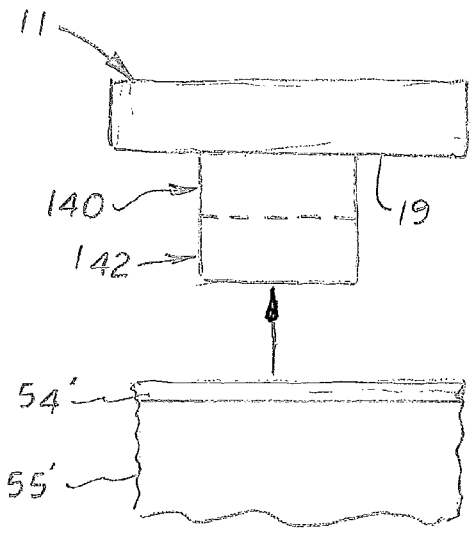
FIG. 10 is a partial side elevational view of a downward extend arm attached to the ring body with a center slot configured to capture the top edge of a bucket.
Figure 11:
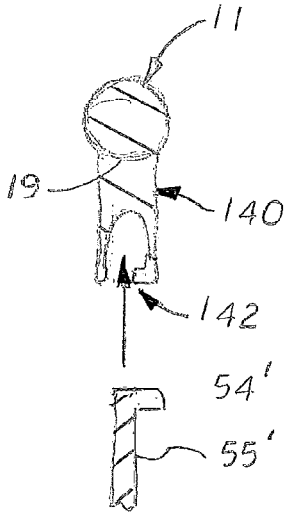
FIG. 11 is a sectional elevational view of an arm and showing the top edge of the bucket being inserted into the center slot.

The ring body 11 may be modified and integrally formed or adhesively attached to the side wall 51 of the bucket 50 as shown in FIGS. 8 and 9. The ring body 11 has an inward biased, lower tip 22 that bends inward to hold the upper edge 54 inside the circular groove 20. The ring body 11 may include a plurality of downward extending arms 140 attached or integrally formed on the bottom surface of the ring body 11. Each arm 140 includes a concave opening 142 configured to capture and attach to the upper edge 54' on a lower bucket 50'. The arms 140 are evenly spaced apart on the ring body 11.

Figure 12:
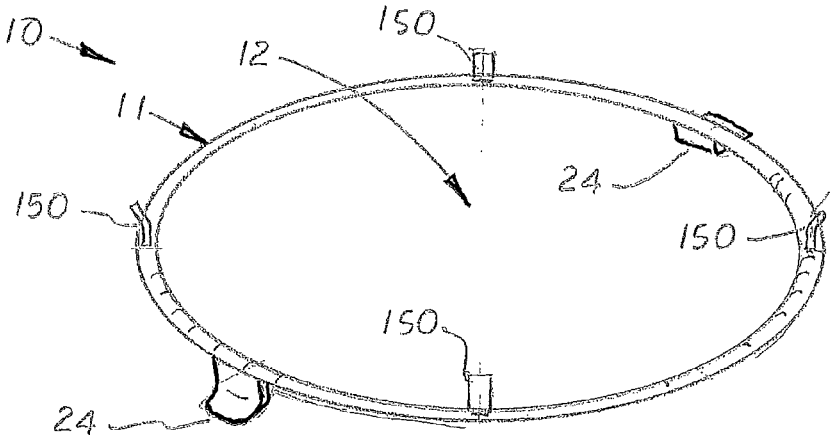
FIG. 12 is a perspective view of another embodiment of the apparatus that includes a ring body with a circular groove formed on it lower surface, two tabs and four upward extending hook elements.
Figure 13:
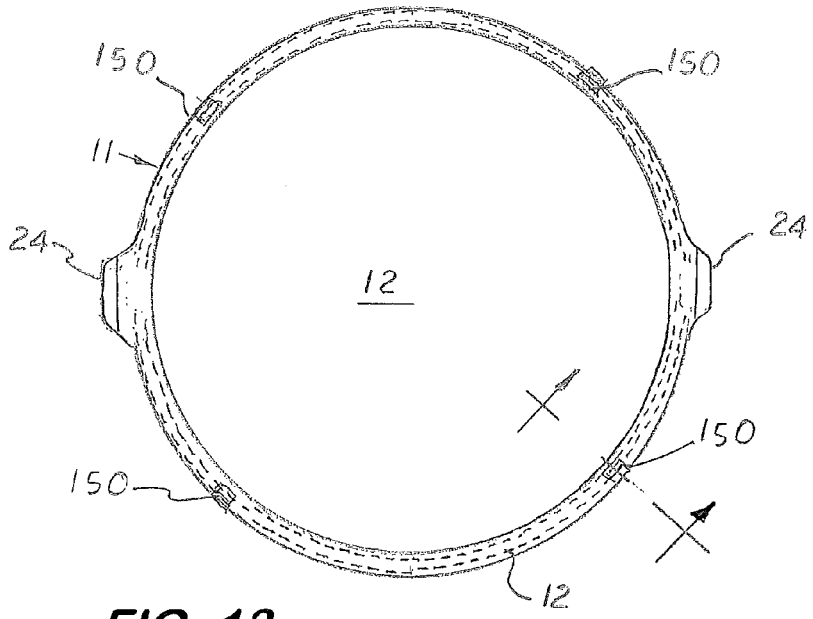
FIG. 13 is a top plan view of the apparatus shown in FIG. 10.

FIGS. 12 and 13 show another embodiment of the apparatus 10 that includes a ring body 11 with a circular groove 20 formed on it lower surface, two tabs 24 that extend outward on opposite sides of the ring body 11 and four upward extending hook elements 150. The hook elements 150 are integrally formed or attached to the top surface 18 of the ring body 11. Each hook element 150 is configured to bend outward and extend around a reinforcement ring 57 formed on the bucket 50 to prevent the ring body 11 from sliding downward over the bucket 50.

Figure 14:
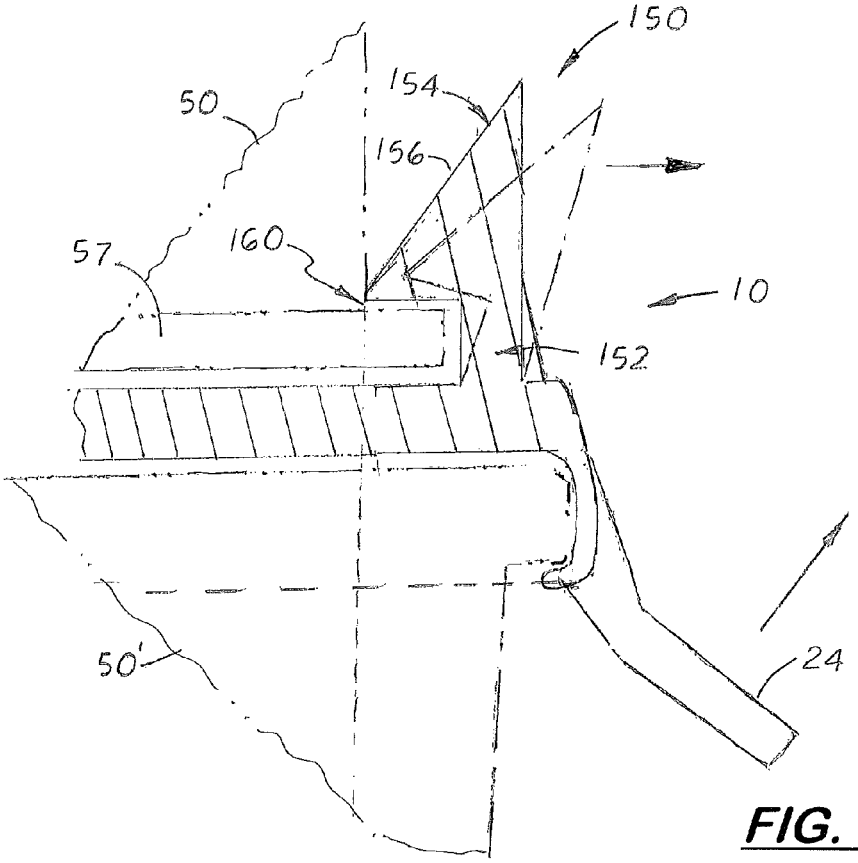
FIG. 14 is a partial, side elevational view of stacked buckets with the apparatus shown in FIGS. 12 and 13 in which the hook elements extend around the lower reinforcement ring on the upper bucket and the circular groove engages the top edge of the lower bucket.

As shown in FIG. 14, each hook element 150 includes a narrow neck 152 and a triangular-shaped head 154. The head 154 includes a sloped inside surface 156 that allows the head 154 to slide smoothly over the reinforcement ring 57 as the ring body 11 slides upward and abuts to the lower surface of the reinforcement ring 57. A slot 160 is formed under the head 154 configured to receive the outer edge of the reinforcement ring 57. When the head 154 extends beyond the reinforcement ring 57, the head 154 is forced inward and the outer edge of the reinforcement ring 57 is captured in the slot 160. In the embodiment shown in the FIGS. 13 and 14, there are four, upward extending hook elements 150 evenly distributed around the ring body 11.

Figure 15:
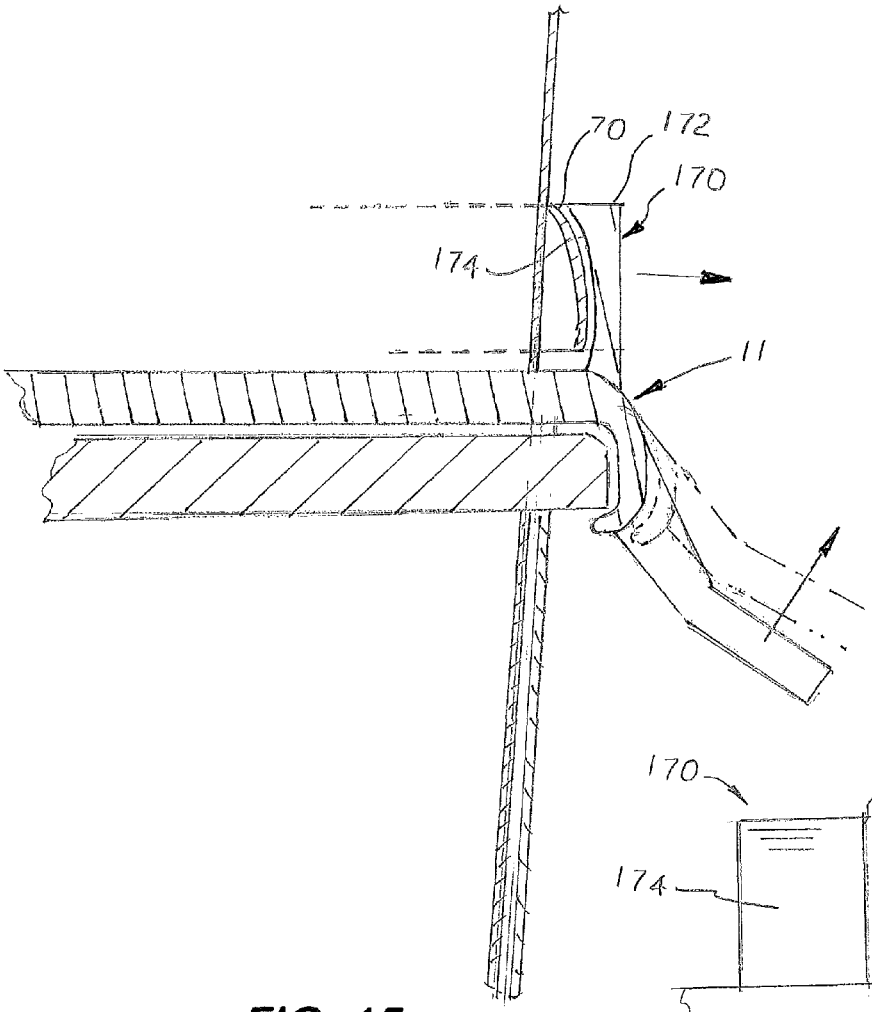
FIG. 15 is another embodiment of the apparatus similar to the apparatus shown in FIGS. 12-14 configured to be used with buckets that use a lower apron collar in place of a reinforcement ring in which the hook elements are replaced with frictional arms that extend upward and press against the outside surface of the apron collar.
Figure 16:
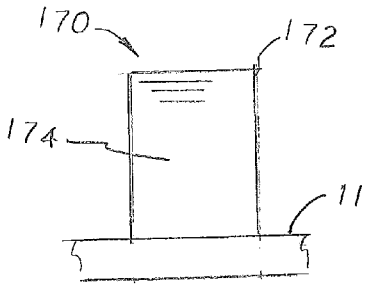
FIG. 16 is a side elevational view of a frictional arm attached to the ring body.

In another embodiment of the ring body 11 is shown in FIGS. 15 and 16 designed to be used with buckets 50, 50' that include a lower, reinforcement apron collar 70 in place of the reinforcement ring 57. The ring body 11 includes a plurality of upward extending arms 170 biased inward and configured to press against and increase the frictional forces against the outside surface of the apron collar 70. Each arm 170 includes a head 172 with a concave, inside surface 174 compatible with the convex outside surface of the apron collar 70. The neck 152 is relatively thin enabling the arms 170 to bend outward when the head 172 slides over the outside surface of the apron collar 70.

During use, the ring body 11 is manually attached to upper bucket 50 with the top surface 18 facing upward until the inside surface 14 of the ring body 11 presses firmly against the outside surface 16 of the bucket 50 or until the top surface 18 of the ring body 11 abuts the lower surface of the reinforcement ring 57 or the apron collar 70. If ring body 11 includes the hook 150 elements or arms 170, hook elements 150 and arms 170 are bent outward over the reinforcement ring 57 or the apron collar 70. The ring body 11 is then forced upward until the heads 172 on the hook elements 150 or arms 170, respectively, extend inward and engage the bucket 50. When properly installed, the circulate groove 20 or opening 142 face downward. A lower bucket 50' is then vertically aligned under the upper bucket 50 and the upper bucket 50 is then forced downward inside the lower bucket 50' until the upper edge 54' of the lower bucket 50' engages the circular groove 20 or opening 142. The buckets 50, 50' are now locked together and the wire handle 58 on the upper bucket 50 may transport the stack of buckets 50, 50'.

The buckets 50, 50' can be locked and removed from the stack of buckets 50, 50' in two ways. First, the lower bucket 50' may be detached, by pulling the two tabs 24 laterally with sufficient force to deform the ring body 11 so the circular groove 20 no longer retains the upper edge 54' of the lower bucket 50'. Second, the upper bucket 50 may be detached from the stack by bending the hook elements 150 or arm 170 outward to disengage the reinforcement ring 57 on the upper bucket 50.

In the embodiments show in the Figs, the outside diameter of the ring body 11 is approximately 12 inches. The inside diameter (also the center opening) of the ring body 11 is approximately 11½ inches. The ring body 11 is round in cross section but may be flat or irregular in shape. The inside surface of the ring body 11 may include a plurality of inward extending points 12 that increase the frictional forces exerted by the ring body 11 on the bucket 50, (see FIGS. 6 and 7).

The circular groove 20 is approximately ⅛ to ¼ inches wide and ¼ inches deep. When the ring body 11 includes a plurality of arms 170, each arm 170 is approximately 1 inch in length, and 1 inch in width. The lower concave opening 142 is approximately 3/16 to ¼ inches wide and deep.

The hook elements 150 are approximately 1 inch in height and configure to bend outward approximately ¼ inches. The slot 160 formed on each hook element 150 is approximately ¼ inches wide and ¼ inches deep. The protruding tabs 24 bend slightly downward from the ring body 11 and extend outward from the outside surface of the ring body 11 approximately ½ inch.

In compliance with the statute, the invention described has been described in language more or less specific on structural features. The invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. An apparatus for interconnecting two buckets stacked together by partially inserting the upper bucket into the lower bucket, each said bucket includes a top opening, a closed bottom panel, a wire handle, cylindrical and downward diverging sidewalls, an upper edge and at least one reinforcement ring formed on said sidewalls, said apparatus comprising:

a. a ring body including a center opening with a fixed diameter smaller than said top opening of said upper bucket and a diameter larger than said bottom panel so that when said ring body is coaxially aligned with said bottom panel and configured to slid upward over the sidewalls of said upper bucket, said center opening also configured so that said ring body is temporarily locked in a fixed location on said sidewalls of said upper bucket and below said top opening, said ring body includes a top surface and a bottom surface with a downward facing groove configured to temporarily engage said upper edge of said lower bucket when said lower bucket is longitudinally aligned and stacked under said upper bucket;

b. at least one edge capturing extending hook member formed or attached to said ring body, said hook member configured to extend upward and engage said reinforcement ring on said upper bucket; and, c. at least one tab member extending outward from said ring body configured to distort said ring body when pulled to disengage said groove on said ring body from said upper edge on said lower bucket.

2. The apparatus, as recited in claim 1, wherein said groove further includes an inward extending lip configured to extend under said upper edge of said lower bucket.

3. The apparatus, as recited in claim 1, wherein said hook member includes a head attached to a neck with a slot formed under said head configured to capture said reinforcement ring on said upper bucket.

4. A stacking bucket, comprising:

a. a bucket with diverging sidewalls, a circular top opening, a circular, closed bottom panel smaller in diameter than said center top opening thereby enabling said bucket to slide into a top opening on a second bucket identical to said bucket, and an upper edge; and, b. a rigid ring body made of elastic material with a bottom surface, a top surface and a center opening larger than the bottom panel on said bucket and smaller than said top opening on said bucket thereby enabling said ring body to slide upward and squeeze against said sidewalls of said bucket and become temporarily locked in a fixed position on said bucket, said ring body includes a groove formed on said bottom surface configured to receive and selectively engage an upper edge of a second bucket with diverging sidewalls and a center opening configured to be longitudinally aligned and stacked under said bucket with said ring body so that said upper edge of said second bucket engages said groove on said ring body.

5. The stacking bucket, recited in claim 4, further including at least two hook members formed or attached to said ring body, each said hook member configured to extend upward and engage a reinforcement ring on said upper bucket.

6. The apparatus, as recited in claim 5, wherein said hook member includes an inward biased head attached to a neck with a slot formed under said head configured to capture said reinforcement ring on said upper bucket.

7. The stacking bucket, as recited in claim 4, further including at least one tab member extending outward from said ring body configured to distort said ring body to removed said ring body from said upper bucket.

8. The apparatus, as recited in claim 7, wherein said groove further includes an inward extending lip configured to extend under said upper edge of said lower bucket.

9. The apparatus, as recited in claim 4, wherein said groove further includes an inward extending lip configured to extend under said upper edge of said lower bucket.

10. The apparatus, as recited in claim 9, wherein said groove further includes an inward extending lip configured to extend under said upper edge of said lower bucket.

11. The apparatus, as recited in claim 4, wherein said ring body has an outside diameter of approximately 12 inches, said center opening has a diameter of approximately 11½ inches, and said circular groove is approximately ¼ inch wide.

12. The apparatus as recited in claim 4, further including a plurality of upward extending arms biased inward and configured to press against and increase the frictional forces against the outside surface of bucket.

* * * * *